US007059075B1

(12) United States Patent
Curry et al.

(10) Patent No.: US 7,059,075 B1
(45) Date of Patent: Jun. 13, 2006

(54) CYLINDER RETAINING MECHANISM

(75) Inventors: Brett Curry, Chicopee, MA (US); Craig A. Mariani, Ludlow, MA (US); Richard J. Mochak, Russell, MA (US)

(73) Assignee: Smith & Wesson Corp., Springfield, MA (US)

( * ) Notice: Subject to any disclaimer, the term of this patent is extended or adjusted under 35 U.S.C. 154(b) by 28 days.

(21) Appl. No.: 10/776,388

(22) Filed: Feb. 11, 2004

Related U.S. Application Data

(60) Provisional application No. 60/446,870, filed on Feb. 12, 2003.

(51) Int. Cl.
*F41C 3/14* (2006.01)

(52) U.S. Cl. ..... 42/62; 42/67

(58) Field of Classification Search ..... 42/62, 42/67, 59

See application file for complete search history.

(56) References Cited

U.S. PATENT DOCUMENTS 702,607 A * 6/1902 Wesson ..... 42/62
4,934,081 A 6/1990 Mooney

* cited by examiner

*Primary Examiner*—J. Woodrow Eldred
(74) *Attorney, Agent, or Firm*—McCormick, Paulding & Huber LLP

(57) ABSTRACT

A cylinder retaining mechanism for a firearm includes a frame having a firing bore and a cylinder having a longitudinal bore. A yoke is pivotally connected to the frame and is operatively connected to the cylinder for selectively pivoting the cylinder between a first position in which the longitudinal bore is aligned with the firing bore, and a second position in which the longitudinal bore is not aligned with the firing bore. A biasing mechanism is housed in the frame and has an engaging portion which is selectively accommodated within an engaging cavity formed in the yoke when the cylinder is in the first position.

20 Claims, 4 Drawing Sheets

CYLINDER RETAINING MECHANISM

CROSS REFERENCE TO RELATED APPLICATIONS

This application claims the benefit of U.S. Provisional Application Ser. No. 60/446,870, filed on Feb. 12, 2003, and herein incorporated by reference in its entirety.

FIELD OF THE INVENTION

This invention relates in general to a cylinder retaining mechanism, and deals more particularly with a cylinder retaining mechanism for a revolver which assures that the cylinder remains in its closed position even during, and immediately following, a discharge of a round of ammunition.

BACKGROUND OF THE INVENTION

Known revolvers employ a rotatable cylinder to selectively position one of a plurality of rounds of ammunition in opposition to the firing bore of the revolver. The cylinder is typically housed within a frame of the revolver for selective movement in or out of the frame during a loading or unloading operation.

FIG. 1 illustrates one example of a known revolver 10. As shown in FIG. 1, the revolver 10 includes a frame 12, a barrel 14, an ejector rod assembly 18 and a cylinder 20 having a plurality of longitudinal bores 22 which are adapted to selectively position, in sequence, rounds of ammunition (not shown) in opposition to the firing bore of the barrel 14.

A yoke stud 24 (shown in phantom) is integrally mated to the frame 12 and provides an axis of rotation to selectively pivot both the yoke 16 and the cylinder 20 from its open position, shown in FIG. 1, to its closed position. A spring biased ball plunger 28 is integrally mated to the yoke 16 and communicates with a ball cavity 30 (shown in phantom) formed in the body of the frame 12.

While successful to a certain degree, the interaction between the spring biased ball plunger 28 and the ball cavity 30 may experience sporadic, operational complications during, and immediately following, the discharge of a round of ammunition. When a round is discharged, the forces which propel the round down the length of the barrel 14 exert a corresponding force in the opposite direction, that is, towards the rear, handgrip portion of the revolver 10. Although the effect of this opposite force is marginal on the interconnected elements of the revolver 10, the manufacturing tolerances inherent in the revolver 10 permit a minute amount of structural translation to occur as a result of this incident and opposite discharge force.

The effect of the structural translation of certain elements in the revolver 10, as a result of the discharge of a round of ammunition and the associated manufacturing tolerances of the revolver 10, may cause the cylinder and yoke assembly, 20/16, to move slightly rearwardly, towards the handgrip portion of the revolver 10. Referring again to FIG. 1, it can be seen that the rearward movement of the yoke 16 may cause the spring biased ball plunger 28 to disengage from the ball cavity 30, thus facilitating the unintended pivoting of the cylinder 20 from its closed position, to the open position shown in FIG. 1. The possibility of the disengagement of the spring biased ball plunger 28 from the ball cavity 30 may increase in proportion to the age of the revolver 10, owing to the increasing age and reduced resilience of the biasing spring, or the like, which serves to bias the ball plunger 28 into contact with the restraining ball cavity 30.

It is therefore the general object of the present invention to provide a cylinder retaining mechanism which advantageously utilizes the recoil forces generated by a firearm during discharge.

SUMMARY OF THE INVENTION

It is an object of the present invention to provide a cylinder retaining mechanism for a revolver.

It is another object of the present invention to provide a cylinder retaining mechanism for a revolver which securely maintains the cylinder in its closed position.

It is another object of the present invention to provide a cylinder retaining mechanism for a revolver which securely maintains the cylinder in its closed position, even during and immediately following the discharge of a round of ammunition from the revolver.

It is another object of the present invention to provide a cylinder retaining mechanism for a revolver which harnesses the force from a discharged round of ammunition to assist in the maintenance of the cylinder in its closed position.

It is therefore an object of the present invention to provide a firearm having a frame with a firing bore and a cylinder having a longitudinal bore, the cylinder being operatively connected to the frame such that the cylinder selectively pivots between a first (closed) position in which the longitudinal bore is substantially aligned with the firing bore, and a second (open) position in which the longitudinal bore is not substantially aligned with the firing bore. A cylinder retaining mechanism is provided for selectively retaining the cylinder in the first position, and includes a biasing member that is integrally mated with the frame. The orientation of the biasing member is designed to remain static when the cylinder pivots between the first position and the second position.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
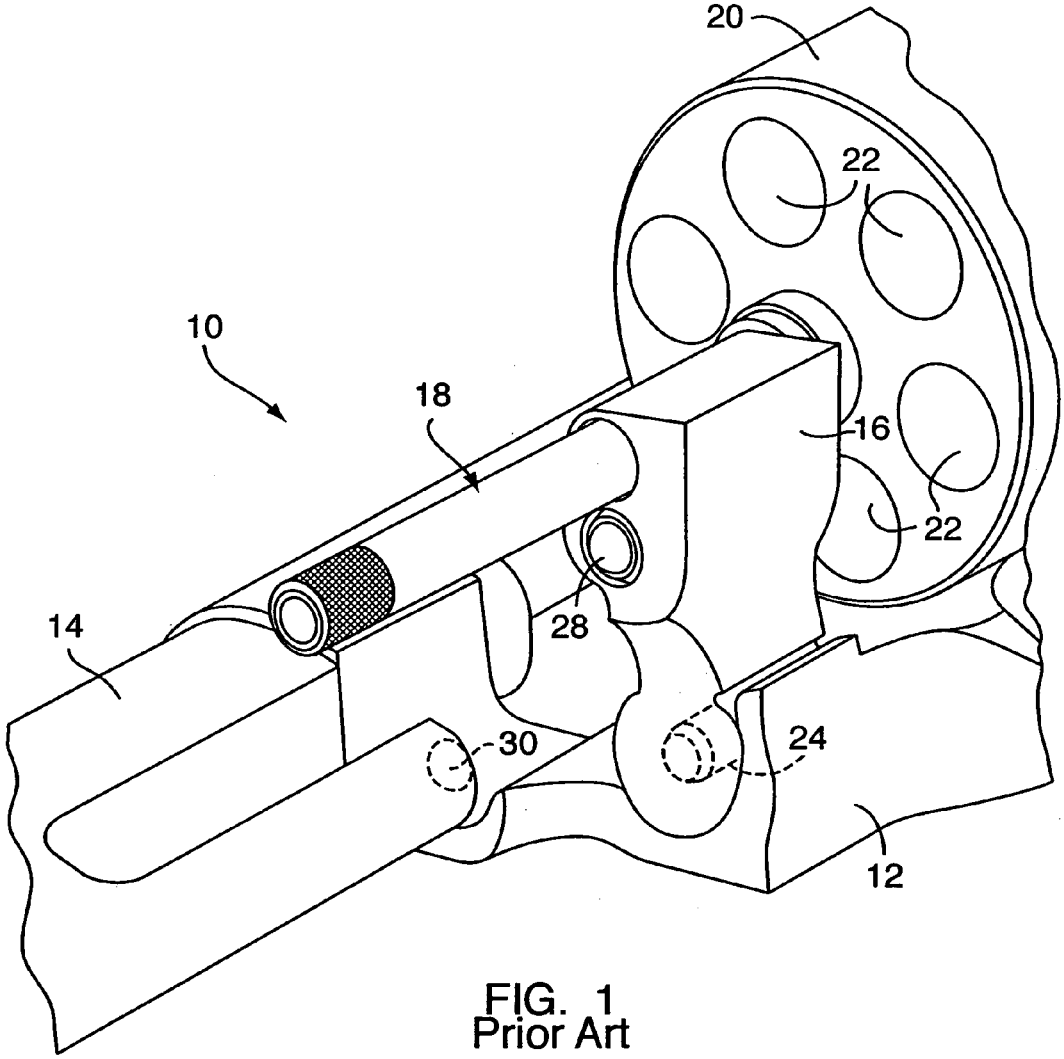
FIG. 1 Prior Art
FIG. 1 illustrates an operational portion of a known revolver.
Figure 2:
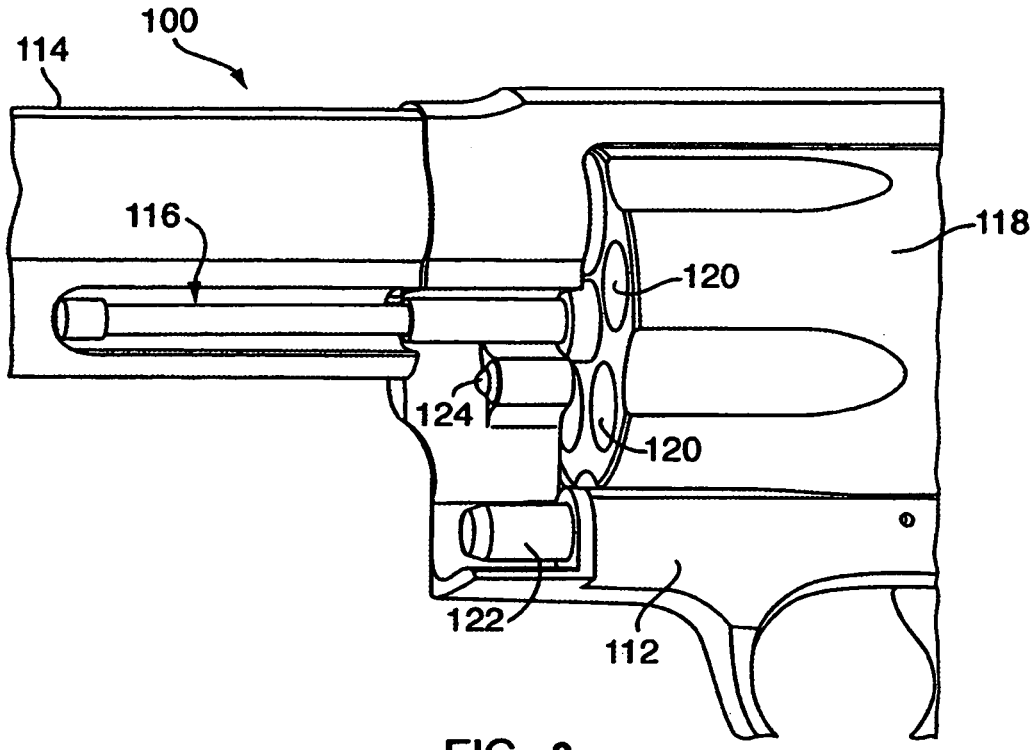
FIG. 2 is a partial cross-sectional view of a revolver having a cylinder retaining mechanism, according to one embodiment of the present invention.

FIG. 2 is a partial cross-sectional view of a revolver 100 having a cylinder retaining mechanism according to one embodiment of the present invention. As shown in FIG. 2, the revolver 100 includes a frame 112, a barrel 114, an ejector rod assembly 116 and a cylinder 118 having a plurality of longitudinal bores 120 which are adapted to selectively position, in sequence, rounds of ammunition (not shown) in opposition to the firing bore of the barrel 114.

A yoke stud 122 is integrally mated to the frame 112 and provides an axis of rotation for the yoke (not shown). A spring biased ball plunger 124 is also integrally mated to the frame 112 and comprises one element of the cylinder retaining mechanism, as will be explained in more detail later.

It is therefore an important aspect of the present invention that, in contrast to known revolvers, the spring biased ball plunger 124 is integrally mated to the frame 112 of the revolver 100. By forming the spring biased ball plunger 124 in the frame 112 of the revolver 100 instead of on the yoke element, as was discussed previously, the present invention is able to constructively utilize the recoil forces resulting from the discharge of a round of ammunition to maintain the cylinder 118 in its closed position, shown in FIG. 2. The manner in which the spring biased ball plunger 124 accomplishes this task will become clear by a review of the subsequent drawing figures and associated discussions relating thereto.

Figure 3:
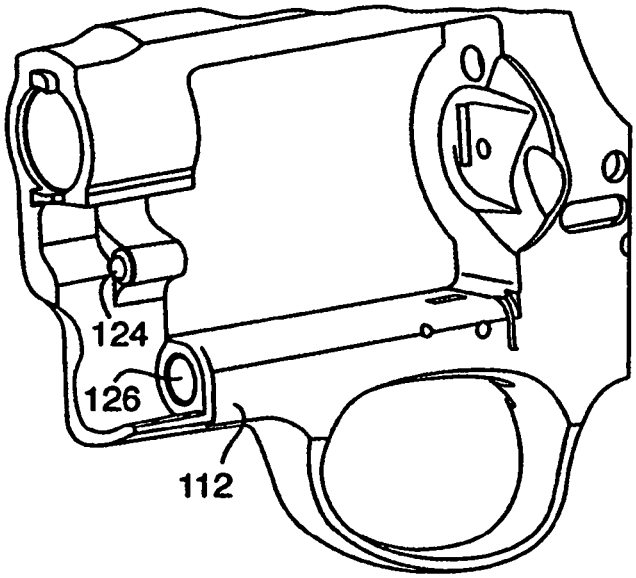
FIG. 3 is a front-side, isometric view of the stripped-down revolver shown in FIG. 2, including one portion of the cylinder retaining mechanism.

FIG. 3 illustrates a stripped-down version of the frame 112 showing the spring biased ball plunger 124 and a stud recess 126. The stud recess 126 is adapted to secure the stud 122 (shown in FIG. 2) therein and provides for selective rotation of the yoke element, to be described shortly.

Figure 4:
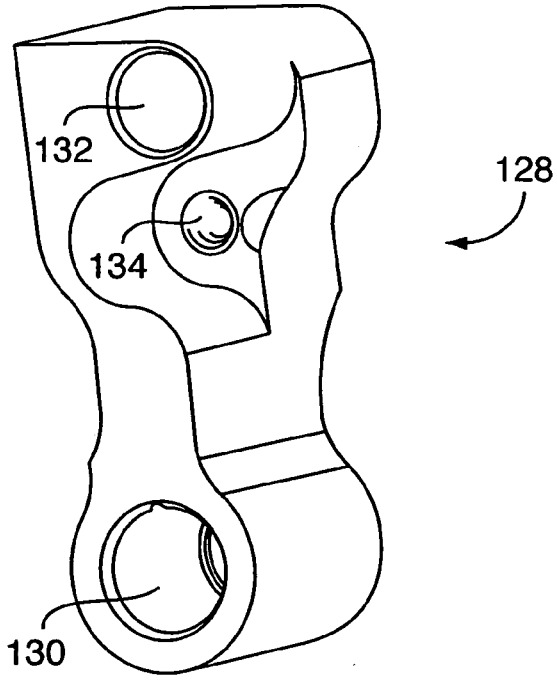
FIG. 4 is an isometric view of a yoke for use with the revolver of FIG. 2, comprising another portion of the cylinder retaining mechanism.

Turning now to FIG. 4, a yoke 128 is shown, comprising another element of the cylinder retaining mechanism of the present invention. As shown in FIG. 4, the yoke 128 includes a stud cavity 130 which pivotably mates with and accommodates the stud 122 (shown in FIG. 2). An ejector bore 132 is also defined in the yoke 128 and provides an aperture through which the ejector rod assembly 116 (shown in FIG. 2) extends, thereby operatively connecting the cylinder 118 (shown in FIG. 2) to the movement of the yoke 128 as it pivots about the stud 122. A ball cavity 134 is formed as a depression in the upper portion of the yoke 128 and is designed to selectively accommodate the spring biased ball plunger 124 (shown in FIG. 2) when the yoke 128, and the cylinder 118 (shown in FIG. 2), are in their closed positions.

It is therefore another important aspect of the present invention that the ball cavity 134 is formed on the yoke 128 itself, rather than on the frame of the revolver 100, in contrast to known revolver architectures. By arranging the ball cavity 134 on the yoke 128 itself, the present invention is able to constructively utilize the recoil forces resulting from the discharge of a round of ammunition to maintain the cylinder 118 (shown in FIG. 2) in its closed position, with great effectiveness.

Figure 5:
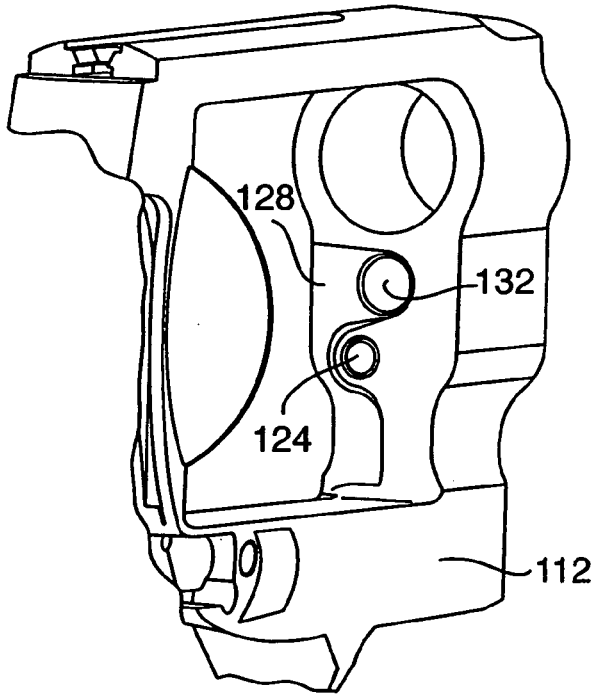
FIG. 5 is a backside, isometric view of the stripped-down revolver shown in FIG. 2, including the yoke of FIG. 4.
Figure 6:
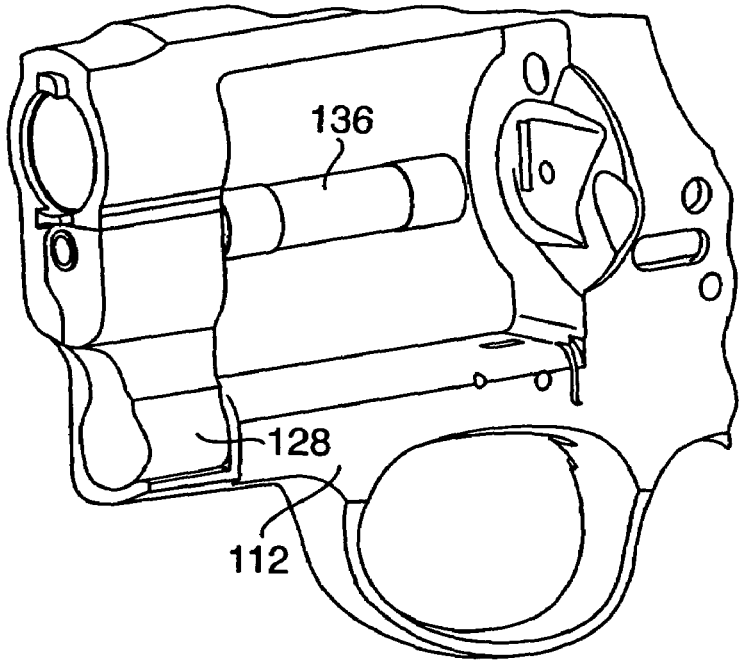
FIG. 6 is a front-side, isometric view of the stripped-down revolver shown in FIG. 2, including the yoke of FIG. 4.

FIGS. 5 and 6 illustrate a rear-side view of the stripped-down frame 112 and a front-side view of the stripped-down frame 112, respectively. As shown in FIG. 5, the yoke 128 integrally mates with the profile of the frame 112 when it is oriented in its closed position. In the closed position of FIG. 5, the rear of the spring biased ball plunger 124 can be seen, with the ball of the spring biased ball plunger 124 being securely accommodated within the hidden ball cavity 134 (shown in FIG. 4) of the yoke 128 (shown in FIG. 4). The ejector bore 132 is also shown in FIG. 5 and permits an arbor portion 136 (shown in FIG. 6) of the ejector rod assembly 116 (shown in FIG. 2) to pass therethrough, upon which the cylinder 118 (shown in FIG. 2) is rotatably supported.

Operation of the cylinder retaining mechanism will now be explained in conjunction with FIGS. 2–6 in combination. When the cylinder 118 of the revolver 100 is in its closed position, shown in FIG. 2, the cylinder 118 may be indexed in a known manner to position one of the plurality of longitudinal bores 120 opposite the firing bore of the barrel 114. Upon actuation of an unillustrated trigger assembly, the discharge of a round of ammunition from the longitudinal bores 120 is initiated. The forces which propel the round down the length of the barrel 114 exert corresponding recoil forces in the opposite direction, that is, towards the rear, handgrip portion of the revolver 100. As discussed previously in connection with known revolver architectures, although the effect of this opposite force is marginal on the interconnected elements of the revolver 100, the manufacturing tolerances inherent in the revolver 100 may permit a minute amount of structural translation to occur as a result of this incident and opposite discharge force.

The effect of this discharge recoil force may cause the cylinder and yoke assembly, 118/128, to move slightly rearwardly, towards the handgrip portion of the revolver 100. In contrast to known revolver architectures, however, it can be seen that the rearward movement of the yoke 128 of the present invention will cause the ball cavity 134 to move farther in the engaging direction, towards the spring biased ball plunger 124. Thus, the interconnectivity of the spring biased ball plunger 124 and the ball cavity 134 is increased during and immediately following the discharge of a round of ammunition.

It is therefore another important aspect of the present invention that the recoil forces which result from a discharge of a round of ammunition are constructively utilized by the revolver 100 to maintain the cylinder in its closed position. That is, as compared to known revolver architectures, any backwards, translational movement of integral elements of the revolver 100 actually reinforces the mating between the yoke 128 and the spring biased ball plunger 124.

While the ball cavity 134 has been described as being formed on the upper portion of the yoke 128, the present invention is not limited in this regard as the ball cavity 134 may alternatively be formed anywhere on the yoke 128 provided that the spring biased ball plunger 124 nests within the ball cavity 134 when the yoke 128 and the cylinder 118 have been pivoted to their closed positions. Indeed, it will be readily appreciated that the structural configuration and orientation of the ball cavity 134 and the spring biased ball plunger 124 is but one expression of a primary objective of the present invention to constructively utilize the discharge force to assist in maintaining the cylinder 118 in its closed position during, and immediately following, the discharge of a round of ammunition.

It will also be readily appreciated that although a spring biased ball plunger 124 has been described, alternative biasing devices apart from springs, and alternative elements apart from substantially spherical, ball-shaped structures may be substituted therefor without departing from the broader aspects of the present invention. Moreover, the present invention equally contemplates that the cylinder retaining mechanism shown in FIGS. 2–6 may be utilized alone, or in conjunction with other, known cylinder retaining mechanisms.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A cylinder retaining mechanism for a firearm, comprising:

a frame having a firing bore;

a cylinder having an outwardly extending ejector rod assembly, said cylinder including a longitudinal bore formed therein;

a yoke having an ejector bore through which said ejector rod assembly is disposed, said yoke being operatively connected to said frame for selective pivoting between a first position and a second position wherein said cylinder is thereby selectively pivoted between said first position in which said longitudinal bore is aligned with said firing bore, and said second position in which said longitudinal bore is not aligned with said firing bore;

a biasing mechanism disposed in said frame, said biasing mechanism having an engaging portion; and an engaging cavity formed in said yoke for selectively accommodating said engaging portion when said yoke is in said first position, wherein said engaging portion is not accommodated in said engaging cavity when said cylinder is in its second position.

2. The cylinder retaining mechanism according to claim 1, wherein:

said biasing mechanism is spring biased; and said engaging portion is a substantially spherical member.

3. The cylinder retaining mechanism according to claim 1, further comprising:

a yoke stud fixed to said frame, said yoke being operatively mounted to said yoke stud for selective pivoting between said first and said second positions.

4. The cylinder retaining mechanism according to claim 1, wherein:

said cylinder defines a plurality of said longitudinal bores formed therein, each of said longitudinal bores being selectively aligned with said firing bore.

5. The cylinder retaining mechanism according to claim 1, wherein:

said ejector rod assembly includes an arbor portion about which said cylinder is rotatably mounted.

6. A cylinder retaining mechanism for a firearm, comprising:

a frame having a firing bore;

a cylinder having a longitudinal bore formed therein;

a yoke pivotally connected to said frame, said yoke being operatively connected to said cylinder for selectively pivoting said cylinder between a first position in which said longitudinal bore is aligned with said firing bore, and a second position in which said longitudinal bore is not aligned with said firing bore;

a biasing mechanism housed in said frame, said biasing mechanism having an engaging portion; and an engaging cavity formed in said yoke for selectively accommodating said engaging portion when said cylinder is in said first position, wherein said engaging portion is not accommodated in said engaging cavity when said cylinder is in its second position.

7. The cylinder retaining mechanism for a firearm according to claim 6, wherein:

said biasing mechanism is spring biased; and said engaging portion is a substantially spherical member.

8. The cylinder retaining mechanism according to claim 6, further comprising:

a yoke stud fixed to said frame, said yoke being operatively mounted to said yoke stud for selective pivoting between said first and said second positions.

9. The cylinder retaining mechanism according to claim 6, further comprising:

an ejector assembly extending through a center portion of said cylinder, said ejector assembly including a protruding portion extending from said cylinder; and an ejector bore formed in said yoke, wherein said protruding portion extends through said ejector bore such that pivoting of said yoke causes pivoting of said cylinder.

10. The cylinder retaining mechanism according to claim 6, wherein:

said cylinder defines a plurality of said longitudinal bores formed therein, each of said longitudinal bores being selectively aligned with said firing bore.

11. The cylinder retaining mechanism according to claim 9, wherein:

said ejector rod assembly further includes an arbor portion housed in said center portion of said cylinder, and about which said cylinder is rotatably mounted.

12. A firearm, comprising:

a frame having a firing bore;

a cylinder having a longitudinal bore, said cylinder being operatively connected to said frame such that said cylinder selectively pivots between a first position in which said longitudinal bore is substantially aligned with said firing bore, and a second position in which said longitudinal bore is not substantially aligned with said firing bore;

a yoke pivotally connected to said frame and operatively connected to said cylinder;

a cylinder retaining mechanism for selectively retaining said cylinder in said first position, said cylinder retaining mechanism includes a biasing member that is integrally mated with said frame; and wherein said biasing member interacts with said yoke when said cylinder is in said first position but does not interact with said yoke when said cylinder is in said second position.

13. The firearm according to claim 12, wherein:

said yoke is pivotally connected to said frame and operatively engaging said cylinder such that pivoting of said yoke causes said cylinder to pivot between said first position and said second position.

14. The firearm according to claim 13, wherein:

said cylinder retaining mechanism includes a cavity formed in said yoke; and said biasing member releasably engages said cavity when said cylinder is in said first position.

15. The firearm according to claim 12, wherein:

said biasing member is a spring biased ball.

16. The firearm according to claim 15, wherein:

said cylinder includes a plurality of longitudinal bores formed therein; and each of said plurality of bores are selectively aligned with said firing bore.

17. The firearm according to claim 13, further comprising:

an ejector assembly extending through a center portion of said cylinder, said ejector assembly including a protruding portion extending from said cylinder; and an ejector bore formed in said yoke, wherein said protruding portion extends through said ejector bore to operatively connect said yoke with said cylinder.

18. A method of selectively retaining a cylinder having a longitudinal bore within a frame of a firearm, said frame defining a firing bore, said method including the steps of:

operatively connecting said cylinder to said frame such that said cylinder selectively pivots between a first position in which said longitudinal bore is substantially aligned with said firing bore, and a second position in which said longitudinal bore is not substantially aligned with said firing bore;

pivotally connecting a yoke to said frame, said yoke being operatively connected to said cylinder;

selectively retaining said cylinder in said first position via a cylinder retaining mechanism, said cylinder retaining mechanism including a biasing member that is integrally mated with said frame; and orientating said biasing member such that said biasing member interacts with said yoke when said cylinder is in said first position but does not interact with said yoke when said cylinder is in said second position.

19. The method of selectively retaining a cylinder having a longitudinal bore within a frame of a firearm, according to claim 18, said method further including the steps of:

operatively engaging said cylinder such that pivoting of said yoke causes said cylinder to pivot between said first position and said second position.

20. The method of selectively retaining a cylinder having a longitudinal bore within a frame of a firearm, according to claim 19, said method further including the steps of:

forming a cavity portion of said cylinder retaining mechanism in said yoke; and releasably engaging said biasing member in said cavity when said cylinder is in said first position.

* * * * *